US005897264A

United States Patent [19]

Baudino

[11] Patent Number: 5,897,264

[45] Date of Patent: Apr. 27, 1999

[54] OFF-CENTER POINT MARKER TIP

[75] Inventor: Rodney J. Baudino, Woodridge, Ill.

[73] Assignee: Sanford Corporation, Bellwood, Ill.

[21] Appl. No.: 08/784,964

[22] Filed: Jan. 16, 1997

Related U.S. Application Data

[63] Continuation of application No. 08/485,542, Jun. 7, 1995, abandoned.

[51] Int. Cl.[6] ..... B43K 1/12; B43K 8/02

[52] U.S. Cl. ..... 401/199; 401/198

[58] Field of Search ..... 404/198, 199

[56] References Cited

U.S. PATENT DOCUMENTS

| | | | |
|---|---|---|---|
| 2,453,201 | 11/1948 | Cushman | 401/199 |
| 3,133,307 | 5/1964 | Steinberg et al. . | |
| 3,610,766 | 10/1971 | Herrnring . | |
| 3,639,070 | 2/1972 | Davidson . | |
| 3,684,389 | 8/1972 | Eron et al. . | |
| 3,814,526 | 6/1974 | Lotfallah . | |
| 4,622,985 | 11/1986 | Jankewitz | 401/199 |
| 5,074,455 | 12/1991 | Peana et al. . | |
| 5,342,136 | 8/1994 | Fukami . | |
| 5,358,349 | 10/1994 | Burroughs et al. . | |

FOREIGN PATENT DOCUMENTS

| | | | |
|---|---|---|---|
| 1418087 | 10/1965 | France . | |
| 2 654 389 | 5/1991 | France . | |
| 3336664 | 4/1985 | Germany | 401/199 |
| 8714866 | 12/1987 | Germany | 401/199 |
| 63-87068 | 6/1988 | Japan . | |
| 3-121900 | 5/1991 | Japan . | |
| 3-57086 | 5/1991 | Japan . | |
| 5-39987 | 5/1993 | Japan . | |
| 5-78592 | 10/1993 | Japan . | |
| 1 350 320 | 4/1974 | United Kingdom . | |
| 2 116 915 | 10/1983 | United Kingdom . | |

*Primary Examiner*—Steven A. Bratlie
*Attorney, Agent, or Firm*—Foley & Lardner

[57] ABSTRACT

An improved marker tip for use in a writing instrument and being of the general type formed of a fibrous and porous material. The tip has a generally elongated body of circular cross section and includes conically-shaped marker surfaces on each of its ends. The converging end of each conically-shaped marker surface is positioned slightly off-center with respect to a central axis of the tip such that each marker surface is comprised of a variety of radial marker widths as well as a writing point. All such radial marker widths are inclined at equal angles with respect to the central axis such that the marker tip, and associated writing instrument, may be held at a single angle with respect to a marking surface when drawing lines of varying widths.

8 Claims, 1 Drawing Sheet

OFF-CENTER POINT MARKER TIP

This is a continuation of application Ser. No. 08/485,542 filed Jun. 7, 1995 now abandoned.

FIELD OF THE INVENTION

The present invention relates generally to writing and marking instruments which employ the use of fibrous and porous marking tips and, more specifically, to an improved marker tip having an off-center point which affords its user the ability to produce marking lines of infinite widths without having to alter the angle at which the writing instrument is held.

BACKGROUND OF THE INVENTION

The use of a fibrous and porous marker tip within a writing instrument is well-known within this field of art. Generally, these tips have elongated bodies which are secured within the "ink-discharge" end of a writing instrument. A portion of each tip is typically housed within the main body of the writing instrument and connects to a reservoir area whereby it is allowed to absorb the liquid marking medium. The remaining portion of the tip extends out from the writing instrument and, as the liquid marking medium is fully absorbed by the tip, may be drawn across a marking surface to produce a line of a given width.

The variety of applications to which these tips have been applied is quite great. Tips have been developed to apply permanent, water-based and even erasable types of ink. Further, tips have been manufactured having various shapes and hardnesses for use upon such marking surfaces as paper, cardboard, wallboard, wood, metal, concrete and other types of masonry surfaces.

The specific designs of the various marker tips which currently exist in the prior art have been primarily dictated by a particular marking need. That is, any one particular marker tip is designed to effectively produce a limited number of line widths—typically, one or two. Any attempt to draw lines of different widths than those which a tip is specifically designed for usually requires a user to hold the writing instrument at awkward and unintended angles. Similarly, the production of thicker lines often requires that a "double line" be drawn with a narrower tip. As a result of these various marking requirements, the shapes of tips currently available include round head, bullet head, pointed, angled and multi-angled. Indeed, it would not be uncommon for one to possess a number of these markers simply to accommodate a variety of marking requirements.

From the foregoing, it should be recognized that there is still a need in the marker industry for a marker tip which, when used as intended with an associated writing instrument, allows its user to create lines having a great variety of widths, can be maintained at a single angle with respect to a writing surface in producing such lines of varying widths, provides a veritable "point" for simple writing purposes and has a body which is easily adapted to the standard writing instruments which currently exist.

SUMMARY OF THE INVENTION

The present invention overcomes the cumulative shortcomings associated with the variety of conventionally-shaped marker tips by providing a marker tip with a uniquely designed off-center marker point. This apparatus allows lines to be drawn of an infinite number of widths between a minimum narrow width and a maximum broad width. The production of all such lines may be accomplished by holding the associated writing instrument at a single angle with respect to the marking surface. Such tip also allows a relatively thin line to be drawn from its point.

The marker tip of the present invention has an elongated body with a substantially circular cross section. The size of this body is such that it may be easily accommodated within the housings of conventional marking instruments. Also in this regard, the elongated body of the marker tip includes a narrow circumferential groove located at its approximate midpoint by which it may be properly secured at the end of a writing instrument.

Each end of the marker tip is substantially conical in shape with the converging portion pointing outward and terminating in a point. However, each point is "off-center" in that it does not intersect the central axis of the elongated body. As a result, the "cone" which is formed at each end of the marker tip has radial edges of varying widths, ranging from a minimum narrow width to a maximum broad width. Such widths, in turn, equate to the infinite number of marker surfaces which may be used to produce lines having varying widths.

Since the central axis of each cone is still parallel with the central axis of the tip's elongated body, the marker tip may be maintained at the same exact writing angle no matter which line width is being produced. Indeed, the marker tip need only be rotated about its central axis until the desired marker surface width is adjacent the intended marking surface. Should it then be desired to use the point of the marker tip for true writing purposes, the instrument may be held at a slightly greater angle with respect to the writing surface (much as a pen or pencil is typically held) and used accordingly.

It is therefore a general object of the present invention to provide a marker tip for use with conventional marking instruments which allows an infinite number of line widths to be drawn between a minimum and maximum line width.

Another object of the present invention is to allow the user of a marking instrument to maintain the marker tip at a single angle with respect to the marking surface regardless of the line width being drawn.

It is a further object of the present invention to provide a marker tip which, in addition to allowing a variety of line widths to be drawn, includes a point by which the tip may be employed as a true writing instrument.

Further objects and advantages of the invention will become apparent to those of ordinary skill in the pertinent art upon review of the following detailed description, accompanying drawing and appended claims.

BRIEF DESCRIPTION OF THE DRAWINGS

The present invention is illustrated more or less diagrammatically in the accompanying drawing, wherein.

Figure 3:
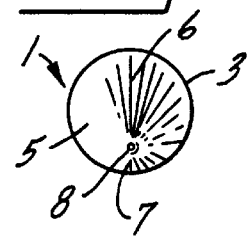
FIG. 3 is an end view if the preferred embodiment of the improved marker tip.

Notice must be taken that the figures are not necessarily to scale and that the embodiments are sometimes illustrated by graphic symbols, phantom lines, and diagrammatic representations. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE DRAWING

Like reference numerals will be used to refer to like or similar parts from FIG. to FIG. in the following description of the drawing.

Figure 1:
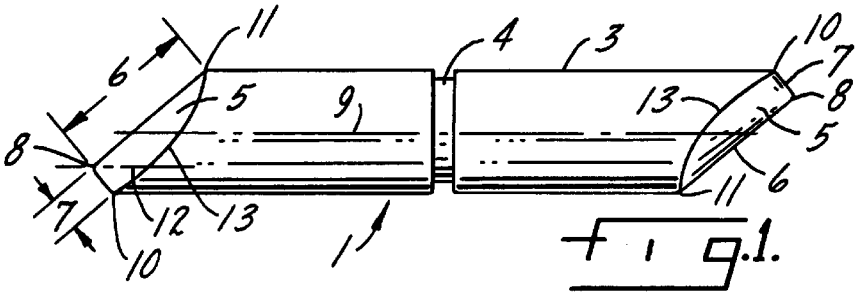
FIG. 1 is a side view of the preferred embodiment of the improved marker tip having a substantially flat writing surface.

Turning first to FIG. 1, the off-center point marker tip of the present invention is shown generally at 1. The tip is primarily defined by its longitudinal exterior surface 3, mounting groove 4 and conical marker ends 5. This particular embodiment shows two conical marker ends 5 which are identical, but simply rotated 180° with respect to each other along the tip's central longitudinal axis 9. It must be noted, however, that the angular orientation of each marker end 5 with respect to the other is purely random.

Marker tip 1 is formed of a fibrous and porous material which allows for the absorption of a liquid marking medium (typically, some form of ink). The present invention also contemplates, however, the formation of a marker tip of other types of materials such as plastic and metal.

Each conical marker end 5 includes both a maximum end width 6 and minimum end width 7. Such design is accomplished by positioning the point 8 of conical marker end 5 closer to one edge of longitudinal exterior surface 3, rather than directly upon the tip's central longitudinal axis 9. Indeed, the present invention contemplates a variety of marker tip configurations wherein the relative lengths of each maximum end width 6 and minimum end width 7 are different for each configuration. For the particular configuration in which point 8 is positioned quite close to one edge of exterior surface 3, a maximum marking line width may be obtained from a pointed round tip of a given diameter.

It should be noted that while conical marker end 5 is off-center with respect to central longitudinal axis 9, its own conical end axis 12 is, indeed, still parallel to central longitudinal axis 9. As a result, every end width of conical marker end 5 (including maximum end width 6, minimum end width 7 and every end width therebetween) is positioned at an equal angle of inclination with respect to conical end axis 12. As a practical matter, therefore, this marker tip 1 may be held at the same angle of inclination with respect to a marking surface regardless of the line width being drawn. The user need only rotate the marker tip, and its associated writing instrument, about the tip's central axis 9 until the desired marker surface width is adjacent the intended marking surface. Drawing the marker tip across the marking surface will then produce a line of the desired width.

The maximum end width 6 and minimum end width 7 as shown in FIG. 1 are substantially flat surfaces which are completely engaged by a writing surface when used as intended. The off-center positioning of conical marker end 5 results in a relatively oval edge 13 being formed at the exterior surface 3 on each end of the marker tip 1. Within such oval edge 13 is both a high edge 10 and a low edge 11 associated with minimum end width 7 and maximum end width 6, respectively. Again, it must be noted that while FIG. 1 offers both the maximum end width 6 and minimum end width 7 of conical marker end 5, there are an infinite number of end widths which exist between these two ends of the spectrum.

Marker tip 1 also includes point 8 for true writing purposes. In conjunction with the instrument in which it is mounted, marker tip 1 may then be held at a slightly greater, and more desirable, angle with respect to the writing surface. The marker tip may then be used as any other ordinary writing instrument.

Figure 2:
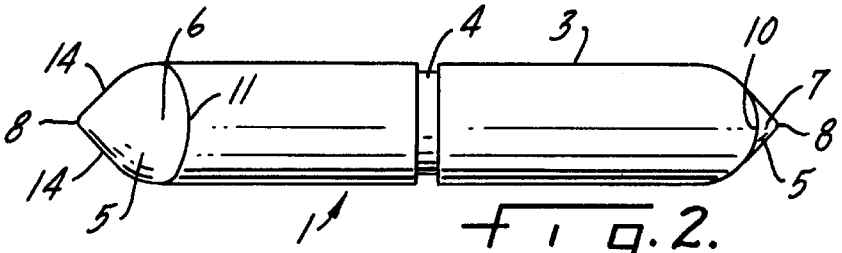
FIG. 2 is a top view of the preferred embodiment of the improved marker tip.

FIG. 2 presents a side view of the present invention and offers a slightly different perspective on the conical marker ends 5. From this view it can be seen that maximum end width 6 is defined as that distance between point 8 and low edge 11. Similarly, minimum end width 7 is defined as that distance between point 8 and high end 10. As previously noted, conical marker end 5 includes an infinite number of radial end widths between maximum end width 6 and minimum end width 7. The top view of the marker tip shown in FIG. 2 also shows the middle end width 14 which is approximately one-half as long as maximum end width 6 and twice as long as minimum end width 7.

Referring now to FIG. 3, an end view of the present invention is shown whereby the radial position of point 8 is exemplified with respect to the marker tip's exterior surface 3. Maximum end width 6 and minimum end width 7 are again defined in FIG. 3 with the shaded surfaces representing the various other end widths which are available for marking purposes.

Figure 4:
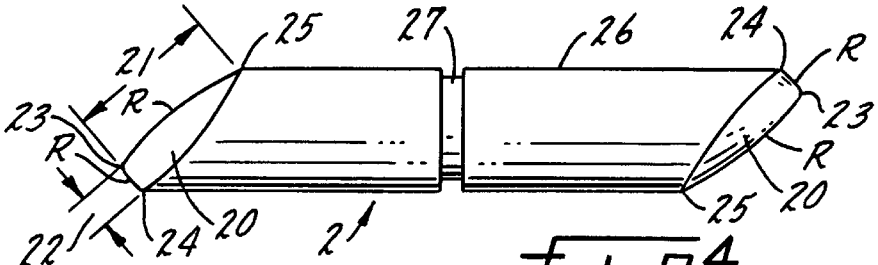
FIG. 4 is a side view of the alternative embodiment of the improved marker tip having a slightly convex writing surface.

FIG. 4 presents an alternative embodiment of the present invention wherein its respective maximum end width 21 and the minimum end width 22, as well as all other end widths between these two, are slightly convex in shape. This arcuate dimension is denoted by the letter "R" in FIG. 4. All other dimensions of the marker tip 2 as shown in FIG. 4 are identical to those of the marker tip shown and described in FIG. 1, including point 23, high edge 24, low edge 25, exterior surface 26 and mounting groove 27.

Figure 5:
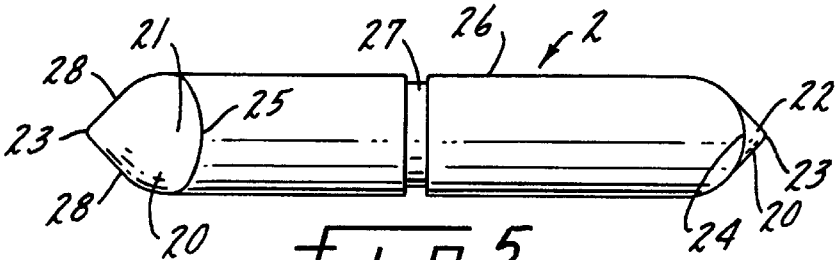
FIG. 5 is a top view of the alternative embodiment of the improved marker tip.

FIG. 5 presents a top view of the marker tip 2 where it can be seen that again maximum end width 21 as defined as that distance between point 23 and low edge 25 and minimum end width 22 is defined as that distance between point 23 and high edge 24. This alternative embodiment, wherein conical marker end 20 includes a slightly convex edge, also includes all end widths which lie between maximum end width 21 and minimum end width 22. For example, the top view of FIG. 5 shows middle end width 28 which is approximately one-half as long as maximum end width 21 and twice as long as minimum end width 22.

Figure 6:
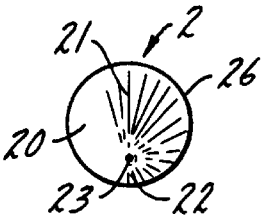
FIG. 6 is an end view of the alternative embodiment of the improved marker tip.

Turning now to FIG. 6, an end view of marker tip 2 is shown which is substantially identical to the end view shown and described in FIG. 3. Indeed, point 23 is positioned substantially closer to one edge of exterior surface 26 such that maximum end width 21, minimum end width 22 and all other end widths lying therebetween may be formed. Point 23 of marker tip 2 is intended to have the same size and shape as point 8 of marker tip 1 so that marker tip 2 may also be employed as a true writing instrument.

While the present invention has been illustrated in some detail according to the preferred embodiment shown in the foregoing drawing and description, it will be apparent to those skilled in the pertinent art that variations and equivalents may be made within the spirit and scope of that which has been expressly disclosed. Accordingly, it is intended that the scope of the invention be limited solely by the scope of the hereafter appended claims and not by any specific wording in the foregoing description.

We claim:

1. A marker tip for use in a writing instrument, the marker tip comprising:

a marker end and an elongated body to be maintained in absorbing relation with a liquid marking medium, the body having an axis;

the marker end having a single point and a generally conical marker surface extending from the point to the outer surface of the body, the point being offset from the axis, such that the marker tip produces lines of varying width by placing the conical marking surface against a writing surface and rotating the marker tip about the central axis of the body, while maintaining a constant angle between the marker tip and the marking surface.

2. The marker tip of claim 1 wherein the point is a sharp point, whereby a fine line may be drawn by contacting only the point with the writing surface.

3. The marker tip of claim 1 wherein the elongated body has a substantially circular cross section.

4. The marker tip of claim 1 wherein the conical marker surface is slightly convex.

5. A marker comprising a marker tip in fluid communication with a reservoir of liquid marking medium, the tip having an elongate, generally cylindrical body having an outer surface and a pointed marking end, the body having an axis, the marking end being offset from the axis, a conical marking surface extending from the marking end to the outer surface of the body, whereby lines of infinitely variable width, between a minimum width and a maximum width, may be drawn by holding the marker tip in contact with a writing surface at a preselected angle wherein a linear portion of the conical marking surface is in contact with the writing surface and rotating the marker about the axis of the elongate body while maintaining the preselected angle, the minimum width being defined by the shortest distance between the marking end and the intersection of the outer surface and the conical marking surface and the maximum width being defined by the longest distance between the marking end and the intersection of the outer surface and the conical marking surface.

6. The marker of claim 5 wherein the pointed marking end is a sharp point, whereby a fine line may be drawn if the point contacts the writing surface and the conical marking surface does not contact the writing surface.

7. The marker tip of claim 5 wherein the elongated body has a substantially circular cross section.

8. The marker tip of claim 5 wherein the conical marker surface is slightly convex.

* * * * *